United States Patent [19]

Meals

[11] Patent Number: 4,789,193

[45] Date of Patent: Dec. 6, 1988

[54] UNIVERSAL SLING FITTING

[75] Inventor: William D. Meals, Lancaster, Pa.

[73] Assignee: Lift-All Company, Inc., Manheim, Pa.

[21] Appl. No.: 109,907

[22] Filed: Oct. 19, 1987

[51] Int. Cl.[4] ..... B66C 1/18

[52] U.S. Cl. ..... 294/74

[58] Field of Search ..... 294/74, 82.11, 82.12, 294/82.1, 77, 75; 24/115 K, 115 R, 122, 6, 115 H, 230.5 R

[56] References Cited

U.S. PATENT DOCUMENTS

| | | | |
|---|---|---|---|
| 156,658 | 11/1874 | Caswell | 294/74 |
| 1,490,066 | 4/1924 | Carr | 294/74 |
| 1,771,314 | 7/1930 | Ramsay | 294/74 |
| 1,959,985 | 5/1934 | Moll | 294/74 |
| 3,153,828 | 10/1964 | Glover | 294/74 |
| 3,167,342 | 1/1965 | Broyles | 294/74 |
| 3,343,862 | 9/1967 | Holmes | 294/74 |
| 3,352,590 | 11/1967 | Barthule | 294/74 |
| 3,360,293 | 12/1967 | Barthule | 294/74 |
| 3,583,750 | 6/1971 | Norton | 294/74 |
| 3,611,710 | 10/1971 | Holmes | 294/74 |
| 3,625,559 | 12/1971 | Lawrence | 294/74 |
| 3,778,095 | 12/1973 | Carr | 294/74 |
| 3,868,137 | 2/1975 | Friend | 294/74 |
| 4,059,302 | 11/1977 | Barthule | 294/74 |

*Primary Examiner*—James B. Marbert

*Attorney, Agent, or Firm*—Martin Fruitman

[57] ABSTRACT

An end fitting for a lifting sling shaped so that the identical fitting can be used at both ends of the sling, because it is constructed so that an outside dimension will slip through the opening of the fitting. The opening is longer than the end fitting's width and has one end curved to accommodate a crane hook while the other end is straight so that the sling web can be attached there.

4 Claims, 2 Drawing Sheets

UNIVERSAL SLING FITTING

SUMMARY OF THE INVENTION

This invention deals generally with material handling and hoist line implements and more specifically with a sling end fitting.

Almost all sling end fittings fall into one of two types. One type has a rounded triangle-like shape with one side straight to be wrapped by the webbing and with the apex of the triangle rounded to fit over a crane hook. Such fittings can be used on a sling where both end fittings are identical and therefore can not pass through each other to form a choker loop, or they can be used with a special fitting which is used to form the choker.

These special choker fittings are larger than the triangle fitting used at the other end of the same web, so that the triangle can slip through the opening within the choker fitting.

While a choker fitting can be constructed as a simple larger triangle, it is possible for the wrapped web to slip around to another side of the larger triangle and must thus require rearrangement before use or the sling will not hang properly.

For that reason, the more common choker fitting is one which has two independent openings formed by the outer triangle and a crossbar above the web attachment side. This arrangement assures that the web will remain captured.

The pass-thru portion of the choker, that part which has a dimension long enough to permit a standard triangle to fit through, can then be formed in two ways. One construction involves making the opening in which the web is located wide enough for the triangle fitting width to slip through. Of course, this construction forces the choker to be wide enough so that the width of the opening is greater than the width of the triangle fitting.

The second construction arrangement is to make the height of the opening for the crane hook large enough to permit the width of the triangle fitting to slip through. The problem here is similar in that it causes the choker fitting to be excessively long, since the hook opening height, the crossbar thickness and the web opening height all add to the total height.

The present invention counteracts these difficulties to furnish a choker fitting used at both ends of the web which has minimum dimensions in both width and height, while also capturing the web so that, unlike the situation with a large triangle, the web can not move around.

This is accomplished by constructing a choker fitting with its exterior shaped as a rectangle with rounded corners, and with a single interior opening of unique shape and dimensions.

The opening is essentially composed of a rectangular element that extends longitudinally from the upper curved end which slips over the crane hook to the web support surface at the bottom. However, this single opening includes two inward extending protrusions located just above the web support surface. These protrusions act to capture the web and maintain it in its original position, but they do not protrude into the opening so far as to interfere with passing a similar end fitting through the full length of the opening from the crane hook end to the web support surface.

Therefore, the total height of the cutout need only be as long as the width of the matching fitting, less, of course, the thickness of the web. It is therefore possible to use two identical end fittings of the invention on both ends of a sling and still use the sling as a choker loop.

This furnishes new utility t a choker sling, since it no longer matters which end is to be the choker fitting. Both will serve equally as well. Furthermore, this permits additional manufacturing economy since, given the same production of choker slings, only one end fitting need be produced, but at twice the quantity.

DETAILED DESCRIPTION OF THE INVENTION

Figure 1:
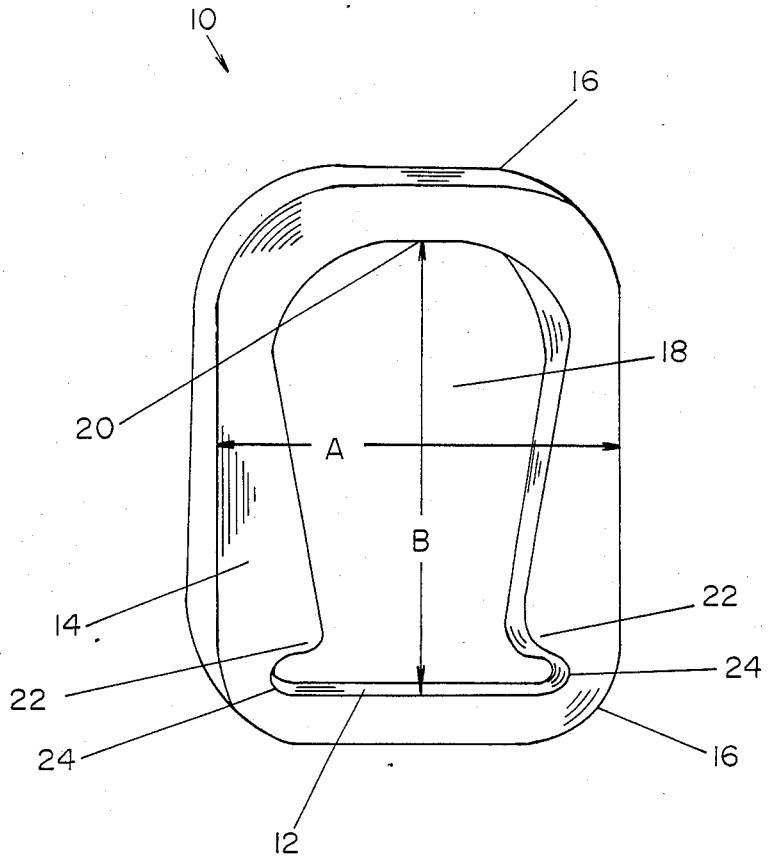
FIG. 1 is a perspective view of a preferred embodiment of the invention.

The preferred embodiment of the invention is shown in FIG. 1 in which end fitting 10 is shown without the web strap which will be wrapped around web support surface 12. The structure of end fitting 10 is quite simple in that it is manufactured from one piece of material, usually cast or forged, into a basically rectangular body 14 with rounded corners 16 and an interior opening 18. Interior opening 18 has a curved surface 20 at one end which can be hung on a crane hook (not shown) and a straight web support surface 12 at the other end. End fitting 10 also includes two protrusions 22 which project into interior opening 18 just above web support surface 12.

Therefore, when a web of approximately the same width as web support surface 12 is wrapped around web support surface 12, it is essentially locked in its location by protrusions 22 and curved ends 24.

End fitting 10 requires a particular relationship between certain dimensions in order to fulfill its utilitarian function of a single design end fitting being usable as a choker fitting when identical fittings are attached to both ends of a sling. This dimensional relationship required is that width A of fitting 10 must be capable of slipping through opening 18 of its matching fitting at the other end of the sling. Therefore, dimension B, the height and maximum dimension of opening 18 is required to be larger than width A plus the thickness of the web (not shown) which will be covering web support surface 12. Of course, dimension B should be enough larger than required so that the matching fitting will slip through opening 18 with no difficulty.

This unique structure then permits each identical end fitting on a sling to act not only as a simple crane hook but also as a versatile choker fitting.

Figure 2:
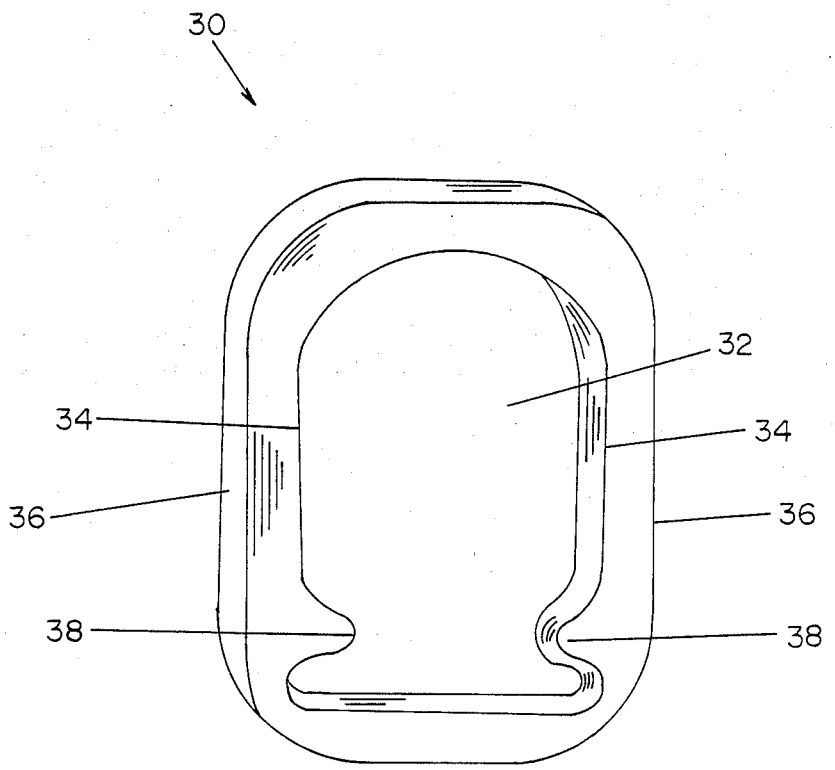
FIG. 2 is a perspective view of an alternate embodiment of the invention.

FIG. 2 depicts another end fitting 30 which differs only slightly from the end fitting of FIG. 1. In FIG. 2, opening 32 has long edges 34 which are essentially parallel to fitting sides 36, and protrusions 38 have distinct top surfaces instead of, as in FIG. 1 being integrated into the sloping edges of the opening.

This structural difference has no significant effect on the function of the end fitting but merely changes the appearance and some manufacturing arrangements, such as the shape of molds.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, protrusions 22 and 38 could be smaller or larger as long as they still function to prevent the web from moving from its location.

What is claimed as new and for which Letters Patent of the United States are desired to be secured is:

1. An end fitting for a lifting sling comprising:

a continuous planar structure, with its length dimension exceeding its width dimension, shaped to enclose an opening, with a first boundary of the opening being a straight surface so that a web will wrap around the straight surface and the adjacent part of the structure, and a second boundary of the opening, which is located opposite from the first boundary, being curved to accept a crane hook, the opening being dimensioned so that the longest dimension of the opening exceeds the dimension of the width of the planar structure; and two protrusions from the structure into the opening, the protrusions being located near the first boundary of the opening so as to limit the movement of a web which is wrapped around the first boundary.

2. The end fitting of claim 1 wherein the planar continuous structure is shaped as a rectangle with rounded corners.

3. The end fitting of claim 1 wherein the longest dimension of the opening is the dimension between the first boundary and the second boundary.

4. The end fitting of claim 1 wherein the other boundaries of the opening comprise essentially straight surfaces joining the protrusions into the opening to the curved second boundary.

* * * * *